US010591122B2

(12) United States Patent
Wang

(10) Patent No.: US 10,591,122 B2
(45) Date of Patent: Mar. 17, 2020

(54) MULTILAYER FLASHING WATER BALL APPARATUS

(71) Applicant: Hua-Cheng Pan, Tainan (TW)

(72) Inventor: Chih-Liang Wang, Tainan (TW)

(73) Assignee: Hua-Cheng Pan, Tainan (TW)

( * ) Notice: Subject to any disclaimer, the term of this patent is extended or adjusted under 35 U.S.C. 154(b) by 0 days.

(21) Appl. No.: 16/584,901

(22) Filed: Sep. 26, 2019

(65) Prior Publication Data

US 2020/0041083 A1 Feb. 6, 2020

Related U.S. Application Data

(63) Continuation-in-part of application No. 15/892,414, filed on Feb. 9, 2018, now Pat. No. 10,458,609.

(51) Int. Cl.
*F21S 10/00* (2006.01)

(52) U.S. Cl.
CPC ..... *F21S 10/002* (2013.01)

(58) Field of Classification Search
CPC ..... F21V 23/0407; F21V 3/02; F21V 23/02; G02B 6/006; G02B 6/009; G02B 6/0076; G02B 6/0088; G02B 6/0036; G02B 6/1886; G02B 6/00; A47G 2033/0827; F21S 10/005; F21S 10/023; F21S 10/002; F21W 2121/00; F21Y 2115/10; B65D 39/00; B65D 81/366; G09F 19/00; G09F 13/00
USPC ..... 40/442, 546, 615; 362/605
See application file for complete search history.

(56) References Cited

U.S. PATENT DOCUMENTS 4,244,130 A * 1/1981 Frois ..... G02B 6/0076 40/442
2003/0147235 A1* 8/2003 Lin ..... F21S 10/002 362/101
2006/0255179 A1* 11/2006 Liao ..... B44C 5/005 239/302
2008/0034627 A1* 2/2008 Schnuckle ..... G09F 19/12 40/306
2014/0268673 A1* 9/2014 Yang ..... F21S 10/002 362/101
2014/0268866 A1* 9/2014 Yang ..... G09F 19/00 362/605
2016/0053951 A1* 2/2016 Wang ..... F21S 8/035 362/644

(Continued)

*Primary Examiner* — Anh T Mai
*Assistant Examiner* — Fatima N Farokhrooz
(74) *Attorney, Agent, or Firm* — Leong C. Lei

(57) ABSTRACT

A multilayer flashing water ball apparatus includes a water ball main body, a base and a light transmissive plate module. The water ball main body is light transmissive and includes a platform with an installation slot. The base is secured onto the bottom portion of the water ball main body and includes light emitting elements for emitting light toward the installation slot. The light transmissive plate module includes multiple light transmissive plates inserted into the installation slot. The surfaces of the light transmissive plates include continuous corresponding patterns formed thereon, and such patterns are visually related to each other to form a serious of motion sequence. The bottom portions of the light transmissive plates correspond to the light emitting elements. With the light source of the light emitting elements flashes sequentially, the continuous corresponding patterns inside the water ball main body generate a dynamic visual effect.

11 Claims, 8 Drawing Sheets

(56) References Cited

U.S. PATENT DOCUMENTS

2016/0069523 A1* 3/2016 Chien ..... H05B 33/08
362/97.1

* cited by examiner

MULTILAYER FLASHING WATER BALL APPARATUS

CROSS-REFERENCE TO RELATED APPLICATION

This is a continuation-in-part of co-pending U.S. patent application Ser. No. 15/892,414 filed on Feb. 9, 2018.

(a) TECHNICAL FIELD OF THE INVENTION

The present invention relates generally to a water ball ornament, and more particularly, to a water lamp design used as a visual decoration in an environment and space.

(b) DESCRIPTION OF THE PRIOR ART

Typically, ornaments placed on desktops in our daily lives include photo frames, toys and decoratives, and most of the ornaments are equipped with the appealing outer appearance and static functions only. Accordingly, a water lamp design having sparkling pieces, sparking powders or decoratives contained therein is able to generate a different visual sensation, and it can also utilize the manual shaking and inverted placement or electrical source to allow the internal sparkling pieces, sparking powders or decoratives to generate the visual sensation of liquid flowing. In addition, with different internal content of the water lamp, different visual sensation can be achieved; therefore, it can achieve the effect of space expansion and extension of various and diverse visual effects, or it can be developed to have multiple functions and entertainments. Accordingly, there is a need for a designer to provide a unique water ball design for environment decorative and ornament.

In view of the above, the present inventor, having been engaged in development of ornaments for years, has conducted various designs and fabrications to provide this invention for an attempt to eventually create an ornament that, in addition to being simply an ornament, applies various factors including decoration, beautification, and interesting to enhance appealing visual experience for observers.

SUMMARY OF THE INVENTION

The primary objective of the present invention is to provide a multilayer flashing water ball ornament design in order to increase the product competitiveness.

Accordingly, the present invention provides a multilayer flashing water ball apparatus, comprising:

a water ball main body having a light transmissive three-dimensional shape, and a moving liquid filled at an internal of the water ball main body; the internal of the water ball main body comprising a platform, and the platform having an installation slot;

a base secured onto a lower portion of the water ball main body; an internal of the base comprising a circuit board corresponding to a bottom portion of the water ball main body, a plurality of light emitting elements and a power source module for providing an electricity; the circuit board electrically connected to the power source module; each one of the plurality of light emitting elements electrically connected to the circuit board and arranged spaced apart from each other in sequence to emit light toward the installation slot; and a light transmissive plate module, in a sequential direction from a front to a rear thereof, comprising: a first light transmissive plate, a second light transmissive plate and a third light transmissive plate; wherein surfaces of the first light transmissive plate, the second light transmissive plate and the third light transmissive plate comprise continuous corresponding patterns respectively, and each of the continuous corresponding patterns forms a continuous motion sequence; and wherein a bottom portion of each of the first transmissive plate, the second transmissive plate and the third transmissive plate includes a light guiding portion extended therefrom, each one of the light guiding portions is inserted into the installation slot, and each one of the light guiding portions corresponds to each one of the light emitting elements respectively.

According to the aforementioned structure and configuration, when an observer views the internal of the water ball main body, the first light transmissive plate, the second light transmissive plate and the third light transmissive plate surfaces are able to form continuous corresponding patterns in a continuous motion sequence. With the light emitting elements arranged at the bottom portion thereof, the continuous corresponding patterns are lit up and off sequentially; consequently, the internal of the water ball main body is able to generate a visual effect of a series of motion sequence produced by the continuous corresponding patterns. For example, the series of motion sequence of the continuous corresponding patterns can be the visual sensation of the swimming motions of a dolphin as illustrated in an exemplary embodiment of the present invention.

DETAILED DESCRIPTION OF THE PREFERRED EMBODIMENTS

Figure 1:
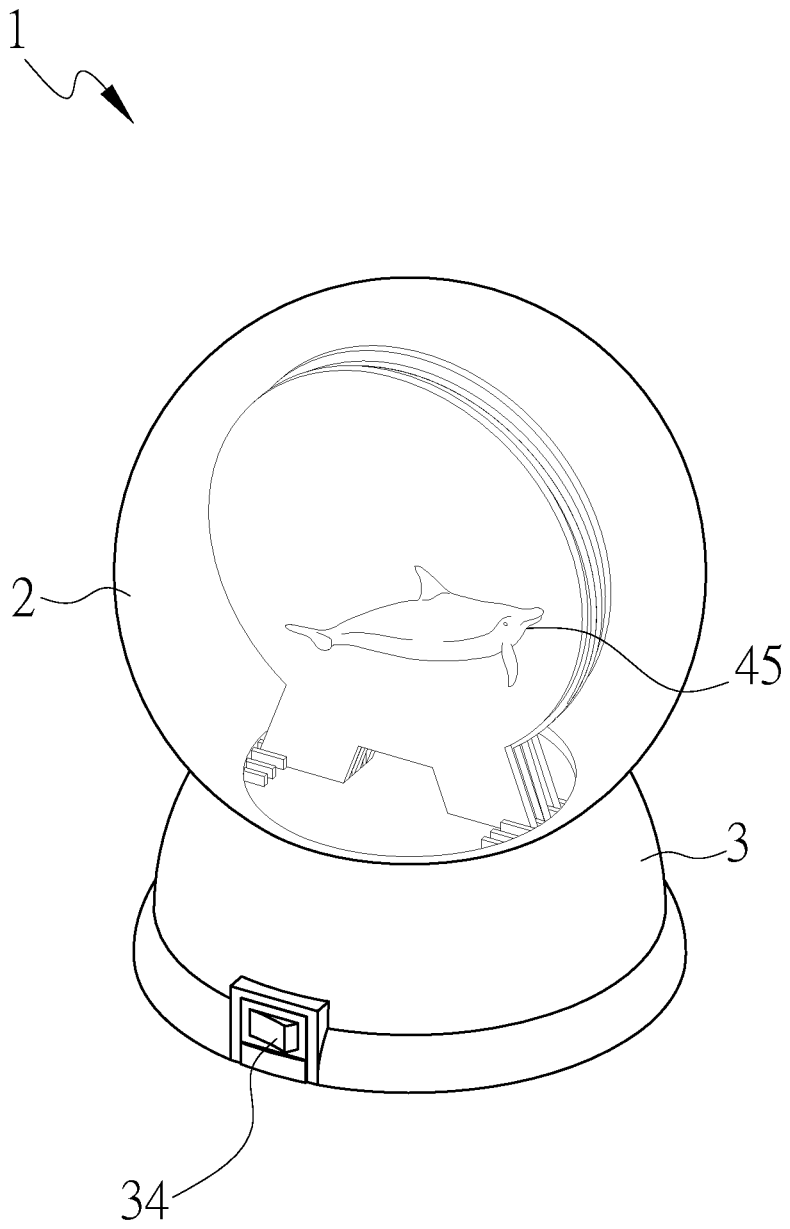
FIG. 1 is a perspective assembly view of the multiplayer flashing water ball apparatus of the present invention.
Figure 2:
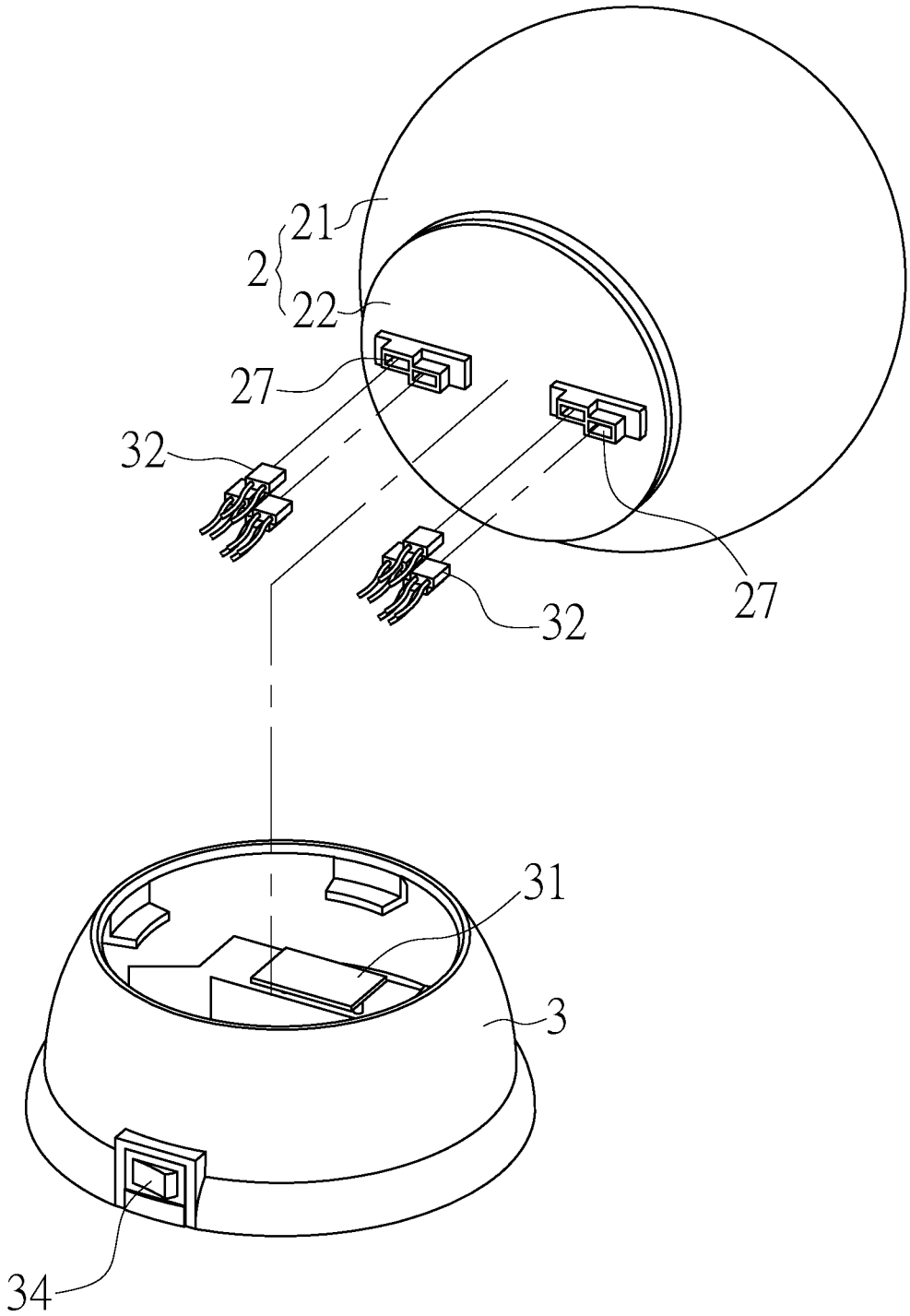
FIG. 2 is a perspective exploded view of the multilayer flashing water ball apparatus of the present invention.
Figure 3:
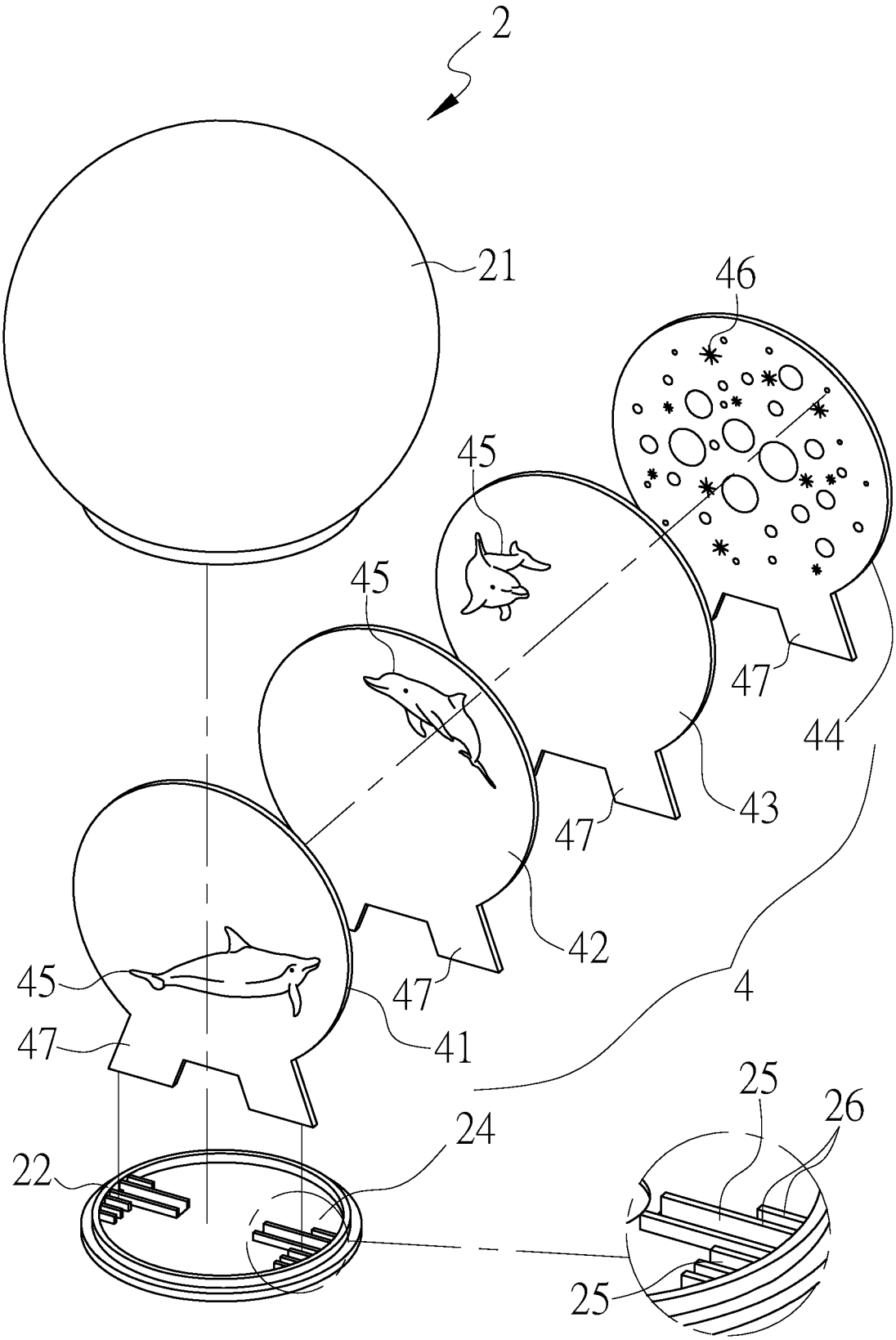
FIG. 3 is an exploded view of the water ball main body of the multilayer flashing water ball apparatus of the present invention.
Figure 4:
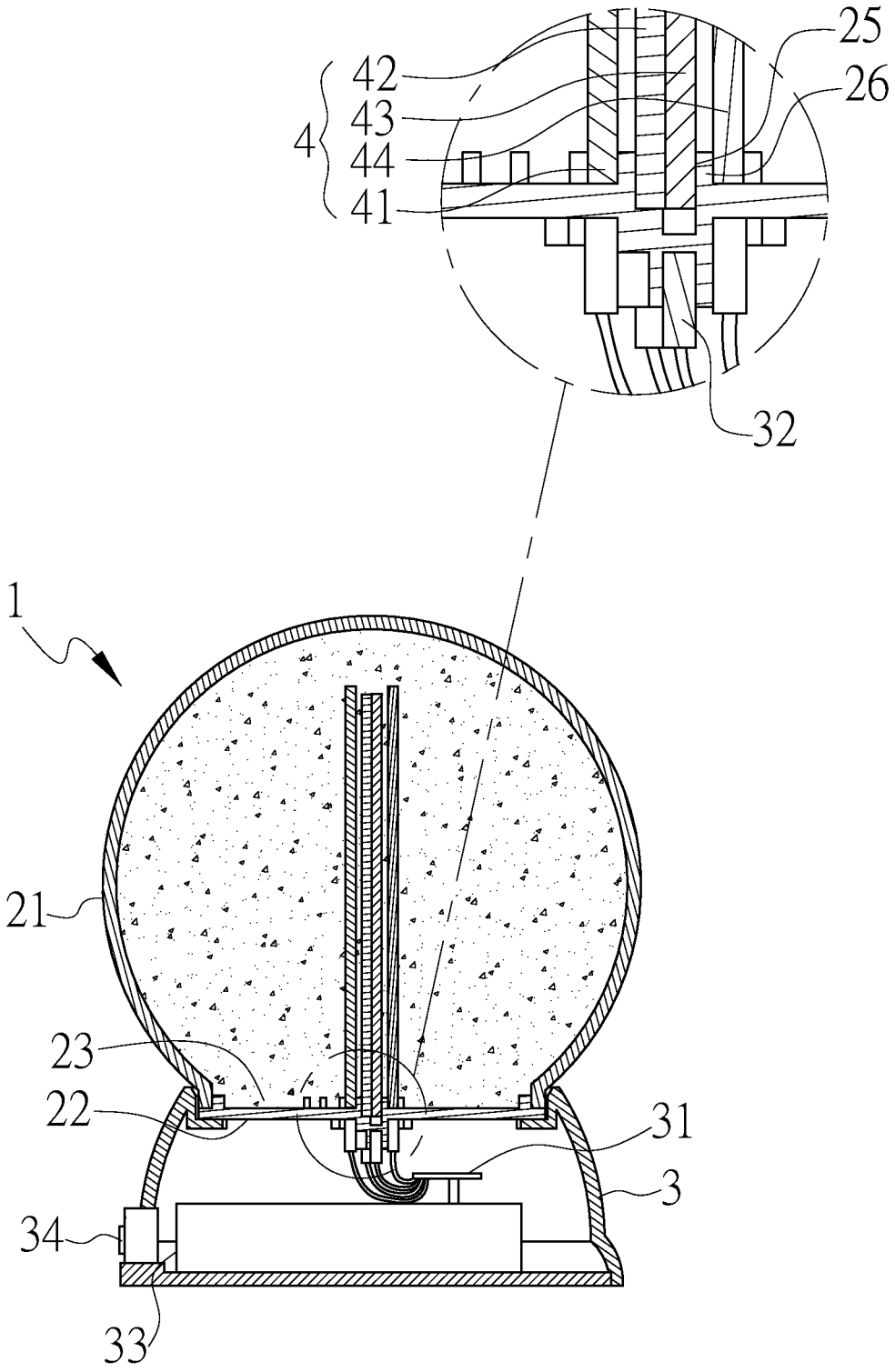
FIG. 4 is a cross-sectional view and a partial enlarged view of the multilayer flashing water ball apparatus of the present invention.

A detailed explanation is provided below to illustrate a multilayer flashing water ball apparatus according a preferred embodiment of the present invention, with reference being had to the attached drawings, wherein FIG. 1 is a perspective assembly view of the multiplayer flashing water ball apparatus of the present invention; FIGS. 2 and 3 are exploded views of the multilayer flashing water ball apparatus of the present invention; and FIG. 4 is a cross-sectional view, together with a partial enlarged view of a portion thereof, showing the multilayer flashing water ball apparatus of the present invention.

Referring to FIGS. 1-4, which show an exemplary embodiment of the present invention, a multilayer flashing water ball apparatus (1) comprises: a water ball main body (2), a base (3) and a light transmissive plate module (4). The base (3) is arranged underneath the water ball main body (2), and the light transmissive plate module (4) is arranged on the base (3) and at the rear of the water ball main body (2).

In addition, the water ball main body (2) includes a light transmissive hollow shell (21) and a light transmissive bottom cover (22). The bottom portion of the shell (21) includes an opening (23), and its internal is filled with moving liquid. The bottom cover (22) is used for sealing the opening (23), and the bottom cover (22) includes a platform (24) extended toward the internal of the shell (21). The platform (24) includes an insertion slot (25). The liquid can be transparent or added with a color dye, or sparkling powders or pieces can be added into the liquid in order to increase its appealing appearance. Alternatively, color dye can be added during the formation of the water ball main body (2) in order to allow it to have light color while being light transmissive. In this exemplary embodiment, the water ball main body (2) has a ball shape for illustration; however, it shall not be used to limit its appearance. In addition, its material is not limited, and it can be made of light transmissive plastic or glass etc.

The base (3) is secured underneath the water ball main body (2), and it can use the attachment method of screw fastening, bonding or locking etc. The internal of the base (3) includes a circuit board (31), a plurality of light emitting elements (32) and a power source module (33) for providing electricity. In addition, the circuit board (31) is installed at the bottom of the insertion slot (25) and is electrically connected to the power source module (33). Each of the light emitting elements (32) is electrically connected to the circuit board (31) and arranged spaced apart from each other. In addition, the light emitting elements (32) are controlled by the circuit board (31) to flash sequentially.

Accordingly, the power source module (33) can be a grid plug, battery pack etc. In this exemplary embodiment, the battery pack is used as an example for illustration. Furthermore, the base (3) includes a switch (34) electrically connected to the power source module (33). The switch (34) is mainly used for conducting or disconnecting the power source in order to activate the light emitting elements to be lit up or off indirectly. In this exemplary embodiment, the light emitting elements (32) are LED, and they can be controlled by the circuit board (31) to show a lighting sequence and color change lighting effect.

The light transmissive plate module (4) is inserted into the installation slot (25) of the platform (24), and in a sequential direction from a front to a rear thereof, it comprises: a first light transmissive plate (41), a second light transmissive plate (42), a third light transmissive plate (43) and a backboard (44). The surfaces of the first light transmissive plate (41), the second light transmissive plate (42) and the third light transmissive plate (43) include the continuous corresponding patterns (45), which may include at least a part that is opaque or impermeable to light, formed thereon respectively. The continuous corresponding patterns (45) form a continuous motion sequence, such as the motion sequence of a swimming dolphin in this exemplary embodiment. The surface of the backboard (44) includes a background pattern (46), which may include at least a part that is opaque or impermeable to light, formed thereon, and the background pattern (46) mainly cooperates with the continuous corresponding patterns (43) to form a theme background. In this exemplary embodiment, the internal of the installation slot (25) includes a plurality of partitions (26) arranged spaced apart from each other in order to separate the first light transmissive plate (41), the second light transmissive plate (42), the third light transmissive plate (43) and the backboard (44). The quantity of the partition is not limited, and it can be formed in such a way that the first light transmissive plate (41), the second light transmissive plate (42), the third light transmissive plate (43) and the backboard (44) are attached onto each other sequentially at the internal of the installation slot (25) without any separation. Alternatively, its structure can also be configured in such a way that the first light transmissive plate (41) is separated from the backboard (44), and the second light transmissive plate (42) and the third light transmissive plate 943) are not separated from each other.

In addition, the bottom portions of the first light transmissive plate (41), the second light transmissive plate (42), the third light transmissive plate (43) and the backboard (44) further include a light guiding portion (47) extended therefrom respectively in order to insert each one of the light guiding portions (47) into the installation slot (32). Each one of the light guiding portions (47) corresponds to a light emitting element (34) or a plurality of light emitting elements. In this exemplary embodiment, each of the light guiding portions (47) is of a U shape; therefore it corresponds to two light emitting elements (32). The bottom portion of the bottom cover (22) includes a plurality of light slots (27). Each one of the light emitting elements (32) is installed inside the light slots (27) respectively. Alternatively, a portion of light emitting elements (32) can be installed at the light slots (27) and another portion thereof are installed outside of the light slots (27); in addition, they can contact with the bottom cover (22) to circumference the light slots (27) in order to increase the light concentration of the light source (L).

Figure 5:
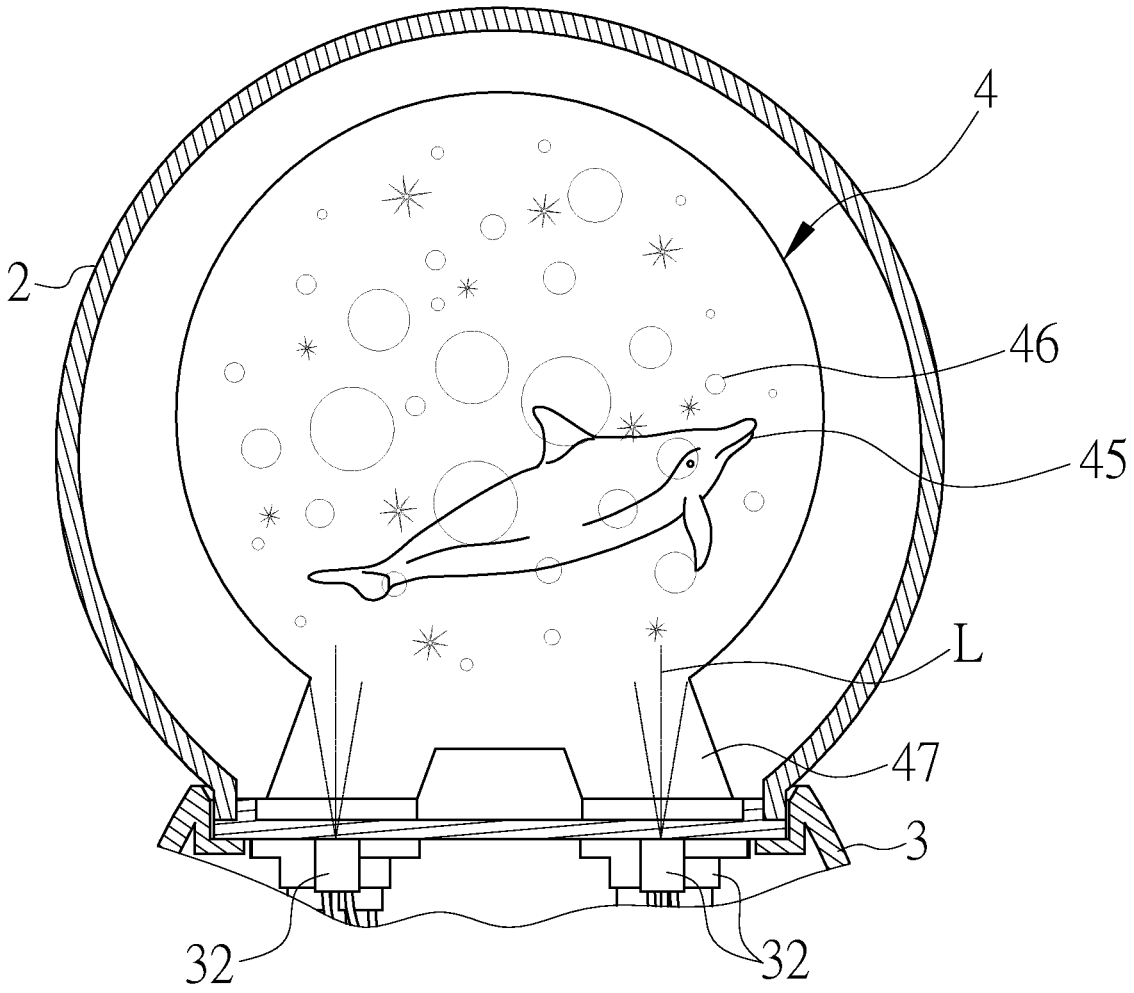
FIG. 5 shows a continuous flashing state of the multilayer flashing water ball apparatus of the present invention.
Figure 6:
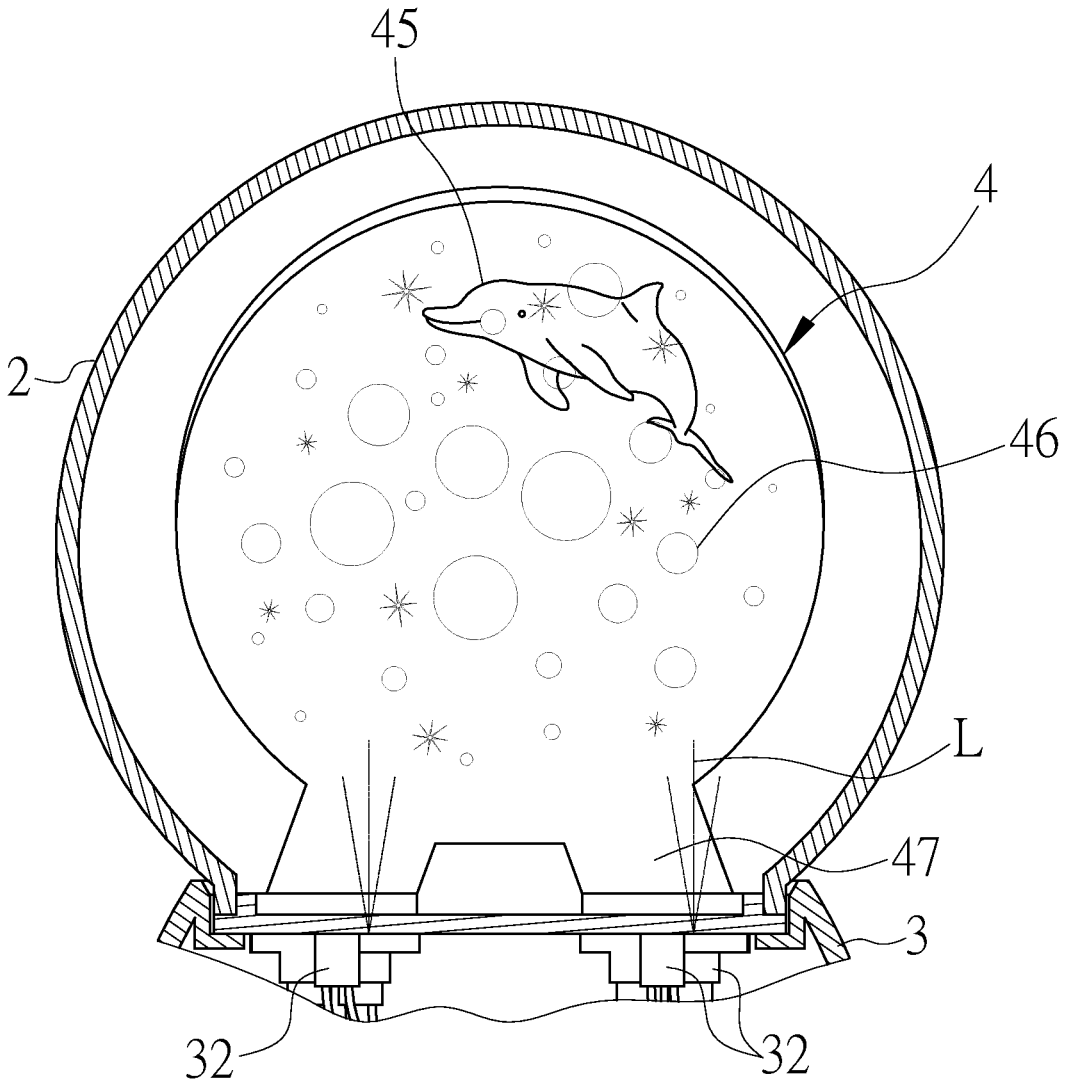
FIG. 6 shows another continuous flashing state of the multilayer flashing water ball apparatus of the present invention.
Figure 7:
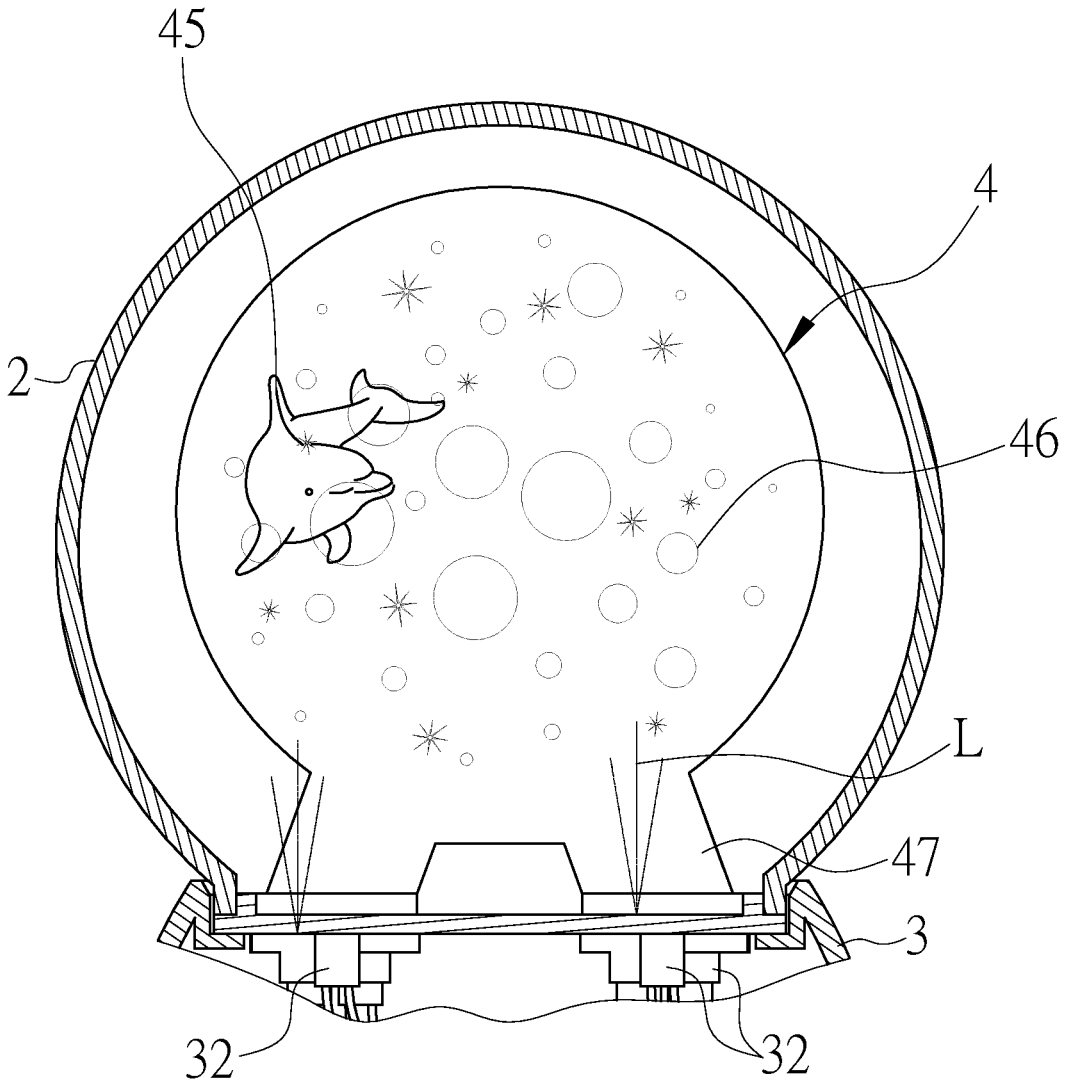
FIG. 7 shows still another continuous flashing state of the multilayer flashing water ball apparatus of the present invention.

As shown in FIG. 5 to FIG. 7, when the switch (34) is turned on to the electrical conductive state, the circuit board (31) is able to control the light emitting elements (32) to be lit up and off sequentially. The light guiding portions (47) can guide the light source (L) to shine toward the internal of the first light transmissive plate (32), the second light transmissive plate (42) and the third light transmissive plate (43) in order to allow the continuous corresponding patterns (45) to be lit up sequentially. Furthermore, the backboard (44) is opaque and its main purpose is to block the light source (L) for scattering outward; in addition, its light guiding portion (47) at the lower portion thereof can include a light emitting element (32) in order to increase the illuminating effect of the background pattern (46). The present invention is not limited to any type or form of the continuous corresponding patterns (45), which can be engraved or patterns with fluorescent paints etc. Since the traveling path of the light source (L) of the light emitting elements (32) is in a direct projection manner, the edges of the continuous corresponding patterns (45) can also show glowing light.

When an observer views the internal of the water ball main body (2), he or she is able to see the continuous corresponding patterns (45) being continuously lit up and flashed sequentially; therefore, the visual effect of a series of motion sequence among the patterns can be perceived. In this exemplary embodiment, patterns of a swimming dolphin can be observed, and the series of motion sequence can show the dynamic patterns of a lively swimming dolphin. Consequently, the flashing and dynamic visual sensation of the present invention can be achieved in order to increase the product competitiveness.

Figure 8:
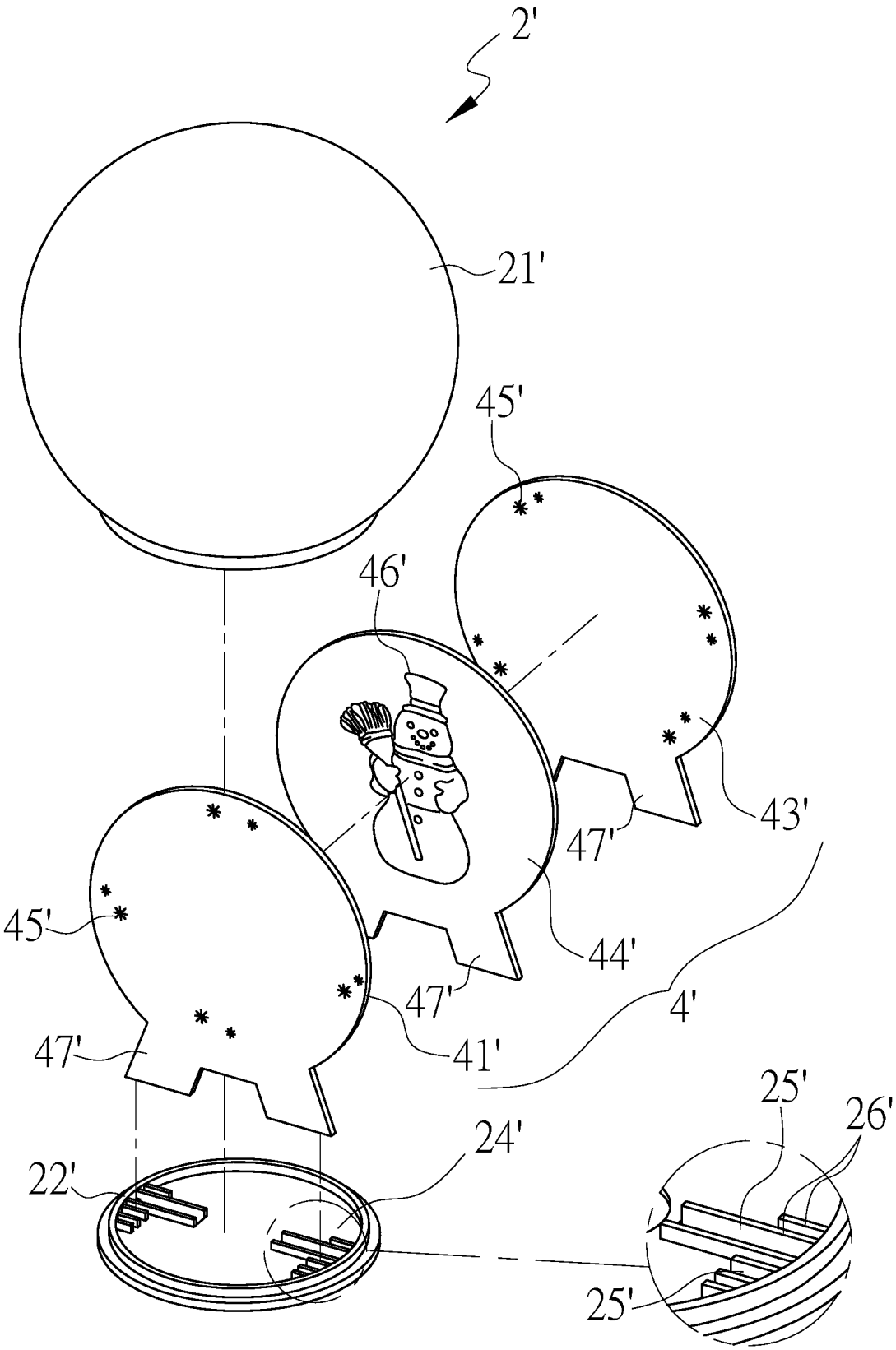
FIG. 8 is an exploded view showing a water ball main body of another embodiment of the present invention.

Further, another embodiment of the present invention is shown in FIG. 8. The instant embodiment of the present invention provides a multilayer flashing water ball apparatus that also comprises: a water ball main body (2'), a base (3'), and a light transmissive plate module (4'). Description concerning these components and designs involved will be provided below. The light transmissive plate module (4') is inserted into an installation slot (25') formed in a platform (24') and comprises, in sequence in a direction from a front to a rear, a first light transmissive plate (41'), a backboard (44'), and a third light transmissive plate (43'). (It is noted that the terms "first transmissive plate" and "third transmissive plate" are used simply for differing two transmissive plates and no intention of indicating the sequence of these plates is involved in the illustration of the instant embodiment.) The first light transmissive plate (41') and the third light transmissive plate (43') have surfaces that are respectively provided with patterns (45'), and such patterns (45') are designed to show, in a successive and sequential manner, a continuous motion. The backboard (44') has a surface that includes a background pattern (46') formed thereon. The background pattern (46') is designed to collaborate with the patterns (45') to form a multilayer theme background. In this exemplary embodiment, the installation slot (25') includes a plurality of partitions (26') that are formed in an interior of the slot and are spaced apart from each other in order to separate the first light transmissive plate (41'), the backboard (44'), and the third light transmissive plate (43'). Alternatively, the first light transmissive plate (41'), the backboard (44'), and the third light transmissive plate (43') are arranged to attach to each other sequentially in the interior of the installation slot (25) and are not spaced or separated from each other. The essential inventive idea of the present invention is the sequential arrangement of the various light transmissive plates and the backboard in a front-rear direction, and for the purposes of allowing the exhibition or observation of the background pattern (46') in the best condition of exhibition, the location of the backboard (44') relative to the first light transmissive plate (41') and the third transmissive plate (43') could be varied, such that, as alternative arrangements in this invention, the backboard (44') may be arranged at a front side of the first light transmissive plate (41') or at a rear side of the third transmissive plate (43') in order to achieve the purpose of allowing the exhibition of the background pattern (46') in the best condition of exhibition in collaborative combination with the various patterns (45').

The above provides an illustration for preferred embodiments of the present invention, and is not intended to limit the features involving in the present invention. It is appreciated that various creations may be made utilizing the technical measures and the idea of the present invention and such creations that fall within the scope of the appended claims belong to the scope of the present invention. Thus, the drawings and the disclosure provided here are not intended to constrain the scope of the present invention. It is believed reasonable to include all those variations and modifications that a person skilled in the art may think up within the technical scope and sprit of the present invention as a part of the scope of this invention as defined in the appended claims

I claim:

1. A multilayer flashing water ball apparatus, comprising:

a water ball main body having a light transmissive three-dimensional shape, and a moving liquid filled in an internal of the water ball main body; the internal of the water ball main body comprising a platform, and the platform having an installation slot;

a base secured to a lower portion of the water ball main body; an internal of the base comprising a circuit board corresponding to a bottom portion of the water ball main body, a plurality of light emitting elements and a power source module providing electricity; the circuit board electrically connected to the power source module; each of the plurality of light emitting elements electrically connected to the circuit board, the plurality of light emitting elements being spaced from each other and arranged to emit light toward the installation slot; and a light transmissive plate module, comprising, in sequence in a direction from a front to a rear thereof, a first light transmissive plate, a second light transmissive plate and a third light transmissive plate; wherein surfaces of the first light transmissive plate, the second light transmissive plate and the third light transmissive plate comprise continuous corresponding patterns respectively, and each of the continuous corresponding patterns forms a continuous motion sequence; and wherein a bottom portion of each of the first transmissive plate, the second transmissive plate and the third transmissive plate includes a light guiding portion extended therefrom, the light guiding portions being inserted into the installation slot to respectively correspond to the light emitting elements, a backboard, wherein the backboard is arranged at one side of the third light transmissive plate and is formed of at least a part that is impermeable to light.

2. The multilayer flashing water ball apparatus according to claim 1, wherein the backboard is inserted in the installation slot and has a surface that is formed with a background pattern.

3. The multilayer flashing water ball apparatus according to claim 1, wherein the first light transmissive plate, the second light transmissive plate and the third light transmissive plate are attached to each other sequentially.

4. The multilayer flashing water ball apparatus according to claim 1, wherein the installation slot includes a plurality of partitions arranged therein and spaced from each other in order to separate the light transmissive plate module.

5. The multilayer flashing water ball apparatus according to claim 1, wherein a bottom portion of the water ball main body includes a plurality of light slots, and the plurality of light emitting elements are inserted into the light slots respectively.

6. The multilayer flashing water ball apparatus according to claim 1, wherein the water ball main body comprises a light transmissive shell and a light transmissive bottom cover, and the platform is arranged on the bottom cover.

7. The multilayer flashing water ball apparatus according to claim 1, wherein the base includes a switch electrically connected to the power source module.

8. The multilayer flashing water ball apparatus according to claim 1, wherein each of the light emitting elements comprises an LED.

9. A multilayer flashing water ball apparatus, comprising:

a water ball main body having a light transmissive three-dimensional shape defining an internal space in which a liquid is filled, a platform being arranged in the internal space of the water ball main body, the platform being formed with an installation slot;

a base mounted to a lower portion of the water ball main body, the base forming an internal space, in which a circuit board corresponding to a bottom portion of the water ball main body, a plurality of light emitting elements, and a power source module providing electricity, wherein the circuit board is electrically connected to the power source module to selectively receive the electricity; each of the plurality of light emitting elements is electrically connected to the circuit board and the plurality of light emitting elements re spaced from each other and arranged to emit light toward the installation slot; and a light transmissive plate module, which comprises, in sequence in a direction from a front to a rear thereof, a first light transmissive plate, a backboard, and a third light transmissive plate, wherein the first light transmissive plate and the third light transmissive plate have surfaces that are respectively formed with continuous corresponding patterns, which form a continuous motion sequence; and wherein a bottom portion of each of the first transmissive plate, the backboard, and the third transmissive plate includes a light guiding portion extended therefrom, the light guiding portions being inserted into the installation slot to correspond to the light emitting elements, wherein the backboard is arranged at one side of the third light transmissive plate and is formed of at least a part that is impermeable to light, the backboard that is inserted in the installation slot having a surface that is formed with a background pattern.

10. The multilayer flashing water ball apparatus according to claim 9, wherein the backboard that is inserted in the installation slot is located at a front side of the first light transmissive plate.

11. The multilayer flashing water ball apparatus according to claim 9, wherein the backboard that is inserted in the installation slot is located at a rear side of the third light transmissive plate.

* * * * *